United States Patent [19]

Rappaport

[11] Patent Number: 4,779,249

[45] Date of Patent: Oct. 18, 1988

[54] IMMERSIBLE AND DISPOSABLE DECORATIVE WRISTWATCH

[75] Inventor: Marcelo Rappaport, Buenos Aires, Argentina

[73] Assignee: Sun S.R.L., Buenos Aires, Argentina

[21] Appl. No.: 49,604

[22] Filed: May 14, 1987

[30] Foreign Application Priority Data

Dec. 4, 1986 [AR] Argentina ..... 306093

[51] Int. Cl.[4] ..... G04B 37/00; A44C 5/00

[52] U.S. Cl. ..... 368/276; 368/282; 224/178

[58] Field of Search ..... 368/276, 281–282; 224/164, 175, 176, 178, 179

[56] References Cited

U.S. PATENT DOCUMENTS

| | | | |
|---|---|---|---|
| 2,227,131 | 12/1940 | Friedman | 368/281 |
| 2,584,270 | 2/1952 | Hucknau | 368/281 |
| 4,023,347 | 5/1977 | Haber | 368/282 |
| 4,155,219 | 5/1979 | Anderson | 368/282 |

FOREIGN PATENT DOCUMENTS

| | | | |
|---|---|---|---|
| 60-82883 | 5/1985 | Japan | 368/281 |

*Primary Examiner*—Vit W. Miska

*Attorney, Agent, or Firm*—Collard, Roe & Galgano

[57] ABSTRACT

An immersible and disposable decorative wristwatch includes at least one watch strap that can be selectively joined at its ends and fitted over the wearer's wrist, and watch works of the quartz oscillator type, run by a battery. The watch strap is laminated and consists of a first ply made of a flexible and waterproof thermoplastic material, and a second ply placed over the first ply, which is also made of a flexible and waterproof thermoplastic material that is transparent over at least a portion of its surface. The second ply is disposed adjacent to the first ply and laminated thereto by means of thermoplastic welds which define at least one hollow hermetically sealed chamber, arranged between the ends of the set of plies so assembled. The watch works are housed within the chamber with the portion of same indicating the time facing the transparent portion of the second ply. The fastening device for selective joining of the ends of the wristwatch assembly are located adjacent to the strap ends, and the chamber housing the watch works is elastically deformable.

8 Claims, 2 Drawing Sheets

IMMERSIBLE AND DISPOSABLE DECORATIVE WRISTWATCH

BACKGROUND OF THE INVENTION

The invention relates to an immersible and disposable decorative wristwatch. More particularly, it relates to such a watch of the battery-run quartz oscillator type.

In order to obtain a watch that is sealed with respect to the medium in which it is immersed, it is known in the conventional art to provide it with a case with one or more tight seals, for the purpose of protecting its inner works from dust, water, etc. If an immersible watch, or one to be used on the beach, is desired, then the seals used must have special characteristics, as the art also teaches.

However, these seals and the cases bearing them in which the watch works are housed, are rather high in cost, which makes it impossible for them to be used in watches of the "disposable" type; a "disposable" watch is understood to be any watch of the above-mentioned type that can be thrown away once the battery runs out, owing to the lost cost of the works.

At the same time, the property of some laminated plastics, such as polyethylene, PVC or others, of being perimetrically weldable, so as to defining hermetically tightly-sealed inner chambers or volumes, is well known.

Accordingly, it is an object of the present invention to provide an improved disposable wristwatch having at least one hermetically-sealed inner chamber.

It is also an object of the invention to provide such a wristwatch having three distinct and separated chambers, optionally arranged one after the other or randomly.

It is a further object of the invention to provide such a wristwatch wherein the chambers not occupied by the watch works contain decorative and/or promotional elements.

SUMMARY OF THE INVENTION

Certain of the foregoing and related objects of the invention have been achieved by the provision of a wristwatch comprising two sheets of flexible thermoplastic polymeric material, with at least one of the sheets being transparent or translucent and at least one of them defining a watchband. The sheets are disposed parallel one above the other, and are welded perimetrically together to at least define one substantially leveled closed chamber, which is laterally deformable and hermetically sealed; the watch works are placed in this chamber prior to perimetral welding - totally enclosed within the same and with the face of the digital display of the watch adjacent to the transparent sheet portion; this chamber is arranged between the two ends of the unit so assembled, which forms a wristwatch strap when the free ends of the band-shaped sheet are joined to each other.

Other objects and features of the present invention will become apparent from the following detailed description considered in connection with the accompanying drawings, which disclose several embodiments of the invention. It is to be understood that the drawings are to be used for the purpose of illustration only, and not as a definition of the limits of the invention.

BRIEF DESCRIPTION OF THE DRAWINGS

In the drawings, wherein similar reference characters denote similar elements throughout the several views.

DETAILED DESCRIPTION OF THE PREFERRED AND ILLUSTRATED EMBODIMENTS

Figure 1:
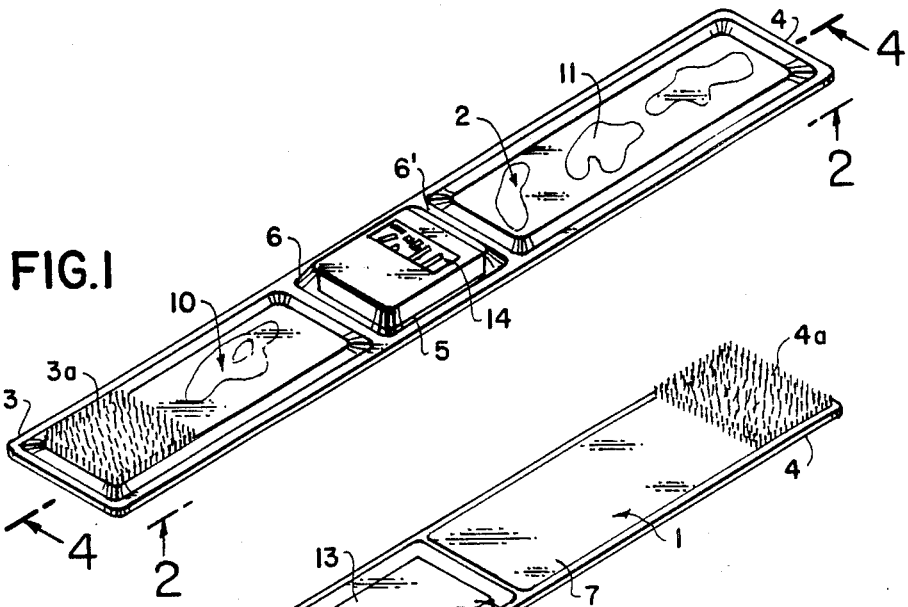
FIG. 1 is a top perspective view of one embodiment of the invention.

Referring now in detail to the drawings, therein illustrated is a wristwatch embodying the present invention which includes a first sheet or web 1 and a second sheet or web 2, both sheets facing each other and being arranged on top of one another. Sheet 1 defines the lower piece, while sheet 2 defines the upper piece.

At least one of the two pieces is in the form of a band, defining a watch strap selectively closable at its ends 3 and 4, the material of the lower piece being a flexible thermoplastic polymeric material, while the material of the upper piece 2 is a transparent flexible thermoplastic polymeric material.

Figure 2:
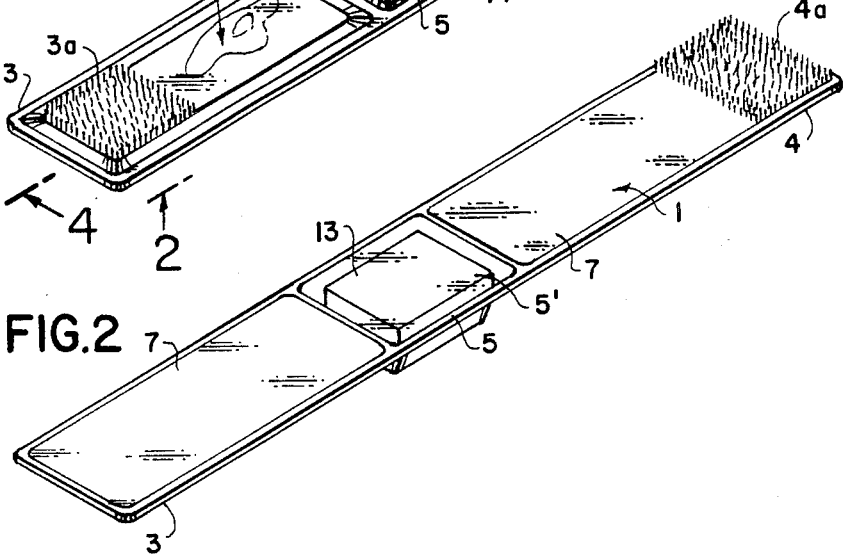
FIG. 2 is a bottom perspective thereof.
Figure 3:
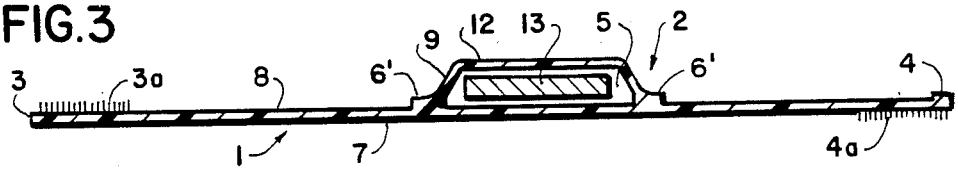
FIG. 3 is a longitudinal sectional view taken of a further embodiment on the invention.
Figure 4:
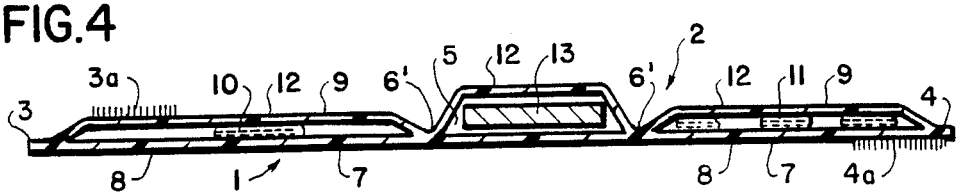
FIG. 4 is a longitudinal sectional view taken along line A—A' of FIG. 1.
Figure 5:
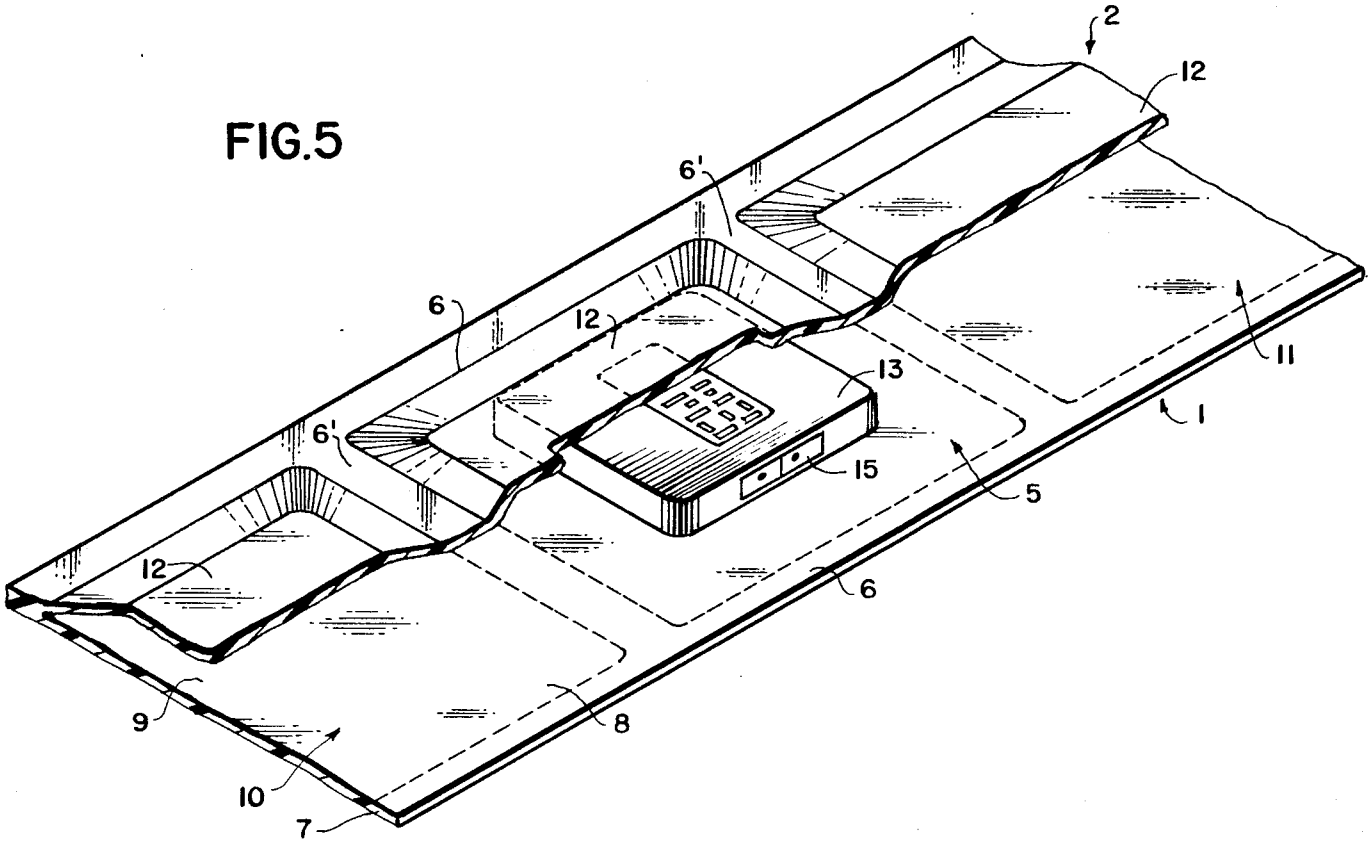
FIG. 5 is a fragmentarily-illustrated, enlarged perspective view of the center section of the watch shown in FIG. 1, with portions broken away.

Both pieces 1 and 2 do not necessarily have to have the same length. In the embodiments of FIGS. 1, 2 and 4, the two pieces are in the form of laminated bands of equal length, whereas FIG. 2 shows that piece 2 is of a shorter length. In other words, it is only necessary that at least one of the two laminated pieces have the total length necessary to form the watch strap, while the other piece may or may not have the same length. One of the two pieces 1, 2, specifically the top one 2, should be translucent or transparent. The forms of the two pieces is not a determining factor of the invention. Although embodiments have been indicated with rectangular flat bands, they can adopt any other shape or design.

Between the two pieces 1 and 2, situated between both ends 3 and 4, an internal chamber or volume 5 is provided which is hermetically sealed and defined by the perimetral welds 6 and 6', the portion corresponding to the upper piece 2 being at least transparent or translucent.

In the embodiments of FIGS. 1, 2 and 4, the two pieces 1 and 2 are laminated together and are of equal length, so that the lower face 7 of piece 1 is the one sitting on the wearer's wrist, when the watch strap is closed; the upper face of piece 1 defines the exposed face of the watch strap 8 when the upper piece 2 only defines the upper region of chamber 5. However, in FIG. 4, it can be seen that the upper face 8 of sheet 1 is disposed opposite the lower face 9 of sheet 2, defining further chambers 10 and 11 situated on opposite sides of the central chamber 5. These chambers 10 and 11 are preferably hermetically sealed and accommodate varied decorative elements, such as iridescent liquids, printed legends, etc., which are visible through the outer face 12 of the second piece 2, due to the latter's least partial transparency.

The weld seams of these chambers 10 and 11 may or may not continue from the previous lateral ones 6, and this will depend on the geometry of the product.

As already mentioned, the ends 3 and 4 of the band can be joined to each other, the means of joining preferably being of the catch device, such as of the well known hook and loop fastener type, whose portions 3*a* and 4*a* are schematically illustrated.

The works of the watch 13 are located inside chamber 5 with at least the display portion 14 thereof being visible, if the window on said face 9 of chamber 5 is decorated or printed; of course, this is a mere alternative, for face 12 of chamber 5 can remain entirely transparent, instead of defining a display window, as shown in FIG. 1.

Of course, any type of joining means 3*a* and 4*a* are usable, and chambers 10 and 11 are subdivisible by one or more additional cross welding beads (not shown).

As shown in FIG. 6, chamber 5, aside from being hermetically sealed, also has to be elastically deformable laterally, in order to allow one to control the contact 15 through the plastic and without perforating or destroying the sealed condition of chamber 5.

As can be readily appreciated, as a result of being housed inside the sealed chamber 5, watch 13 may be used at the beach and even in the water, without harm or damage. The "disposable" condition is set by the fact that, once the battery runs out, the watch cannot be used without destroying its seal.

It should also be noted that within chambers 10 and 11, if a liquid is placed, the pressure of the wrist on the band will create very special effects, such as patterns due to the varied density of the liquid upon the variable volume of said chambers.

While only several embodiments and examples of the present invention have been described, it is obvious that many changes and modifications may be made thereunto, without departing from the spirit and scope of the invention.

What is claimed is:

1. An immersible and disposable decorative wrist watch comprising:

a battery-run watch works having a time display section; and at least one laminated watch strap having opposite ends and means for selectively joining said ends together to allow the strap to be fitted onto the wearer's wrist, said laminated strap including a first lower ply and a second upper ply placed over said first ply, both plies being of similar width and thickness, said first and second plies being made of an elastic flexible and waterproof thermoplastic material, and said second ply being at least partially transparent over at least a portion of its surface and being welded to said first ply by means of thermoplastic welds to define at least one hollow hermetically sealed chamber disposed therebetween, arranged between the strap ends so assembled and in which said watch works are movably housed in said chamber with the time display section thereof facing said transparent portion of said second ply, said means of selective joining said ends of the wrist watch strap being located adjacent to said ends, and the portions of said plies defining said chamber being elastically deformable towards the interior of said chamber and selectively in contact with the controls of said watch.

2. The wristwatch as claimed in claim 1, wherein said the first ply has a length equivalent to the length of the total watch strap, while the second ply has a shorter length.

3. The wristwatch as claimed in claim 1, wherein said second ply has a length equivalent to the length of the total watch strap, while the first ply has a shorter length.

4. The wristwatch as claimed in claim 1, wherein said plies have substantially the same length, defining between them at least three hermetically sealed chambers, the center one of which houses said watch works and the other chambers of which house decorative elements.

5. The wristwatch as claimed in claim 4, wherein said decorative elements included printed matter, legends and liquids which, on flattening the walls of the chamber in which they are housed, permit the color to show through and be modified.

6. The wristwatch as claimed in claim 1, wherein said means of joining are of the catch type.

7. The wristwatch as claimed in claim 1, wherein said watch works are of the quartz oscillator type.

8. A method for assemblying an immersible and disposable wrist watch comprising:

placing a battery-run watch works having a time display section on a first sheet of elastically deformable flexible waterproof thermoplastic material:

covering said watch works with a second sheet of elastically deformable flexible waterproof thermoplastic material;

welding said two sheets together with a thermoplastic weld to define a hermetically sealed chamber around said watch works, said chamber being slightly larger than said watch works to permit its movement therein;

forming at least one sheet of said thermoplastic material adjacent said hermetically sealed chamber into a watchband; and attaching means for selectively joining the ends of said watchband around a wearer's wrist.

* * * * *